US006467661B1

(12) United States Patent
Mistretta et al.

(10) Patent No.: US 6,467,661 B1
(45) Date of Patent: Oct. 22, 2002

(54) ADJUSTABLE SHOULDER STRAP ASSISTING DEVICE

(75) Inventors: Louis A. Mistretta, Amherst; Richard S. Binko, Buffalo, both of NY (US); Floyd V. Edwards, Spring Creek, NV (US); Kenneth F. Munroe, Getzville, NY (US)

(73) Assignee: Kerl, Inc., Cheektowaga, NY (US)

( * ) Notice: Subject to any disclaimer, the term of this patent is extended or adjusted under 35 U.S.C. 154(b) by 0 days.

(21) Appl. No.: 09/708,934

(22) Filed: Nov. 7, 2000

Related U.S. Application Data

(60) Provisional application No. 60/169,776, filed on Dec. 9, 1999.

(51) Int. Cl.[7] ..... A45F 3/12

(52) U.S. Cl. ..... 224/264; 224/265; 224/643; 2/268

(58) Field of Search ..... 224/264, 265, 224/643; 2/267, 268

(56) References Cited

U.S. PATENT DOCUMENTS

| | | | | |
|---|---|---|---|---|
| 1,871,223 | A | | 8/1932 | Reese |
| 2,421,736 | A | * | 6/1947 | Wein |
| 2,505,272 | A | * | 4/1950 | Blalock et al. |
| 2,654,887 | A | * | 10/1953 | Hookstratten |
| 2,808,188 | A | * | 10/1957 | Chlumsky |
| 3,083,885 | A | * | 4/1963 | Ware |
| 3,114,486 | A | | 12/1963 | Flexman |
| 3,154,787 | A | * | 11/1964 | Newman |
| 3,774,825 | A | * | 11/1973 | Schone et al. |
| 3,882,914 | A | * | 5/1975 | Strutz |
| 4,479,595 | A | | 10/1984 | Opsal |
| 4,676,418 | A | | 6/1987 | Lowe |
| D298,386 | S | * | 11/1988 | Hirahara |
| 4,879,768 | A | * | 11/1989 | McClees et al. ..... 2/268 |
| 4,949,401 | A | | 8/1990 | Kimsey, Jr. ..... 2/102 |
| 5,131,576 | A | | 7/1992 | Turnipseed ..... 224/262 |
| 5,250,345 | A | * | 10/1993 | Chu |
| 5,278,998 | A | | 1/1994 | Book ..... 2/102 |
| 5,284,279 | A | | 2/1994 | Sason et al. |
| 5,292,044 | A | * | 3/1994 | Reimers ..... 224/264 |
| 5,323,942 | A | | 6/1994 | Dahan |
| 5,361,412 | A | | 11/1994 | Perry ..... 2/69 |
| 5,487,498 | A | | 1/1996 | Gleason |
| 5,503,314 | A | | 4/1996 | Fiscus |
| 5,539,931 | A | * | 7/1996 | Fizer et al. ..... 2/268 |
| 5,547,461 | A | | 8/1996 | Levis ..... 602/19 |
| 5,551,614 | A | * | 9/1996 | Ham ..... 224/264 |
| 5,558,556 | A | * | 9/1996 | Froehlich |
| 5,566,871 | A | * | 10/1996 | Weintraub ..... 224/264 |
| 5,577,648 | A | | 11/1996 | Sason et al. ..... 224/637 |
| 5,634,576 | A | | 6/1997 | Arbel ..... 224/153 |
| 5,634,579 | A | | 6/1997 | Baclawski ..... 224/637 |
| D424,301 | S | * | 5/2000 | Swierz ..... D3/327 |
| 6,179,178 | B1 | * | 1/2001 | Stegmeyer ..... 224/264 |

* cited by examiner

*Primary Examiner*—Gregory M. Vidovich
(74) *Attorney, Agent, or Firm*—Hodgson Russ LLP

(57) ABSTRACT

An adjustable, shoulder-strap assisting device having an elongate support member with a non-smooth surface on a shoulder engaging side. The elongate support member also has a deformable, rigid insert disposed therein such that the support member is capable of being custom fitted about the shoulder of the user in a non-slipping position. The shoulder-strap assisting device conforms to the contour of the user's shoulder and receives the shoulder strap of a backpack, golf bag, suitcase or the like and prevents the shoulder strap from moving relative to the device such that the load carried by the strap does not shift on the shoulder of the user.

18 Claims, 4 Drawing Sheets

ADJUSTABLE SHOULDER STRAP ASSISTING DEVICE

CROSS-REFERENCE TO RELATED APPLICATION

Applicant hereby claims priority based on U.S. Provisional Application No. 60/169,776 filed Dec. 9, 1999, entitled "Adjustable, Shoulder Strap Assisting Device" which is incorporated herein by reference.

FIELD OF INVENTION

The present invention pertains generally to items capable of being supported from a shoulder strap, for example, backpacks, golf bags, luggage and the like, and pertains specifically to an adjustable, shoulder strap assisting device for use with these type of items.

BACKGROUND OF THE INVENTION

Apparatuses for supporting a load from a person's shoulder typically include a shoulder strap. The shoulder strap for backpacks, golf bags, luggage, and the like typically comprises a band of flexible material constructed out of leather or man-made materials. The a straps typically have uniform thickness and width throughout. However, some straps, such as those used with golf bags, have a varying thickness and/or padding for the portion that rests on the shoulder of the user. Also, the width of the strap may be increased at the point engaging the shoulder. These type of straps are typically used on one shoulder. In some instances, such as with backpacks, the straps may be used on both shoulders.

The straps conform to the shape of the shoulder of the user. However, these flexible straps are sometimes susceptible to movement and slippage that can cause the load to shift. A shifting load can cause discomfort, loss of balance, or even injury to the spine and lower back.

Accordingly, what is needed is an adjustable, shoulder-strap assisting device that conforms to the contour of the shoulder and that prevents slippage or movement of the shoulder strap relative to the shoulder.

SUMMARY OF THE INVENTION

The present invention meets the above-described need by providing an adjustable, shoulder-strap assisting device. The present invention generally provides an elongate support member having a non-slip surface on a shoulder engaging side. The elongate support member also has a deformable, rigid insert disposed therein such that the support member is capable of being custom fitted about the shoulder of the user in a non-slipping position.

In a preferred embodiment the present invention provides an elongate support member that is formed from a multiple layer construction. A first layer has a surface for engaging directly with and assisting the shoulder strap on the item to be carried. The first surface preferably contains some type of surface characteristic designed to inhibit motion of the shoulder strap.

A second layer on the support member has a non-slip surface with ribbing or the like to prohibit movement. The surface of the second layer engages directly with the shoulder of the user and is formed to follow the contour of the user's shoulder by bending a deformable insert disposed inside the support member in such a manner as to conform to the user's shoulder.

The first and second layers are attached to each other by adhesives or the like. The rigid, deformable insert is disposed in the support member between the first and second layers. The insert is rigid but can be deformed to match the contour of the user's shoulder.

A pair of straps are also disposed between the first and second layers. The straps are disposed substantially perpendicular to the longitudinal axis of the support member and extend outward from the support member to form a loop. The ends of each strap detachably connect to one another to form the loop. The loops extend around and secure the shoulder strap to the support member.

As will become evident from the following detailed description, the present invention provides a shoulder strap assisting device, however, the design features of the present invention could also be incorporated directly into a section of the shoulder strap itself to form an integral part of a strap. Thus, the present invention can be used as a stand-alone shoulder strap assisting device and can be used as an integral part of the strap for luggage, golf bags, backpacks and the like.

Accordingly, the present invention advantageously provides both a shoulder strap assisting device and a shoulder strap design. The device adjusts to the contour of the user's shoulder and prevents motion and slippage of the strap to avoid unwanted shifts in the load. The deformable insert can be shaped and reshaped repeatedly for use by different individuals having different sized shoulders.

BRIEF DESCRIPTION OF THE DRAWINGS

The invention is illustrated in the drawings in which like reference characters designate the same or similar parts throughout the figures of which.

DETAILED DESCRIPTION OF THE PREFERRED EMBODIMENTS

The present invention now will be described more fully hereinafter with reference to the accompanying drawings, in which preferred embodiments of the invention are shown. This invention may however be embodied in many different forms and should not be construed as limited to the embodiments set forth herein; rather, these embodiments are provided so that this disclosure will be thorough and complete, and will fully convey the scope of the invention to those skilled in the art.

Figure 1:
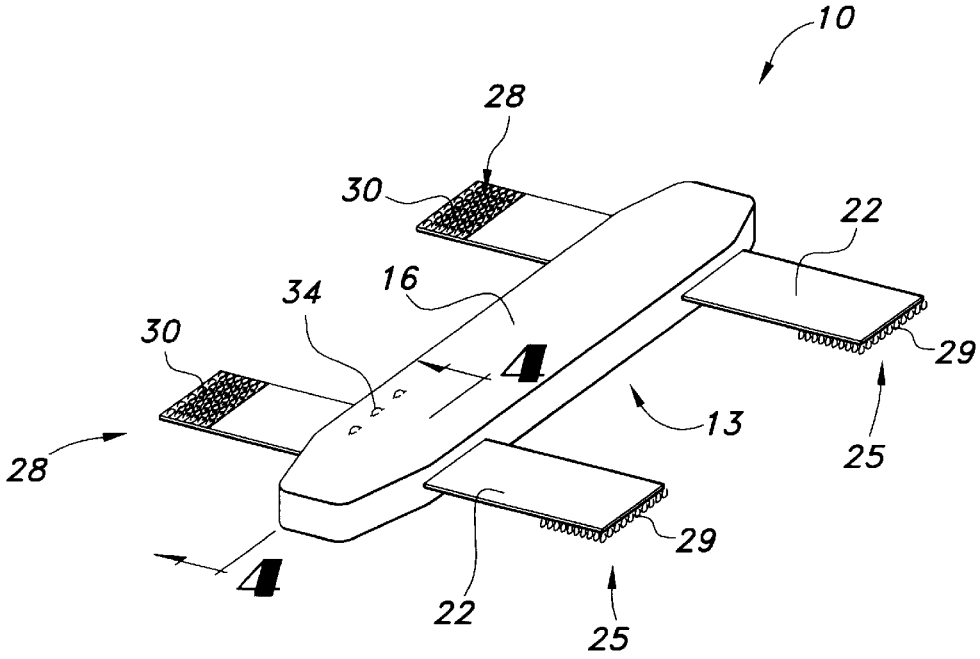
FIG. 1 is a perspective view of the adjustable shoulder strap assisting device of the present invention.

In FIG. 1, the adjustable, shoulder-strap assisting device 10 of the present invention includes an elongate support member 13. The elongate support member has a first surface 16 and a second surface 19 (shown in FIG. 2). The first and second surfaces 16, 19 are disposed on opposite sides of the elongate support member 13. The first and second surface 16, 19 are disposed substantially parallel and in spaced apart relation to one another. The surfaces 16, 19 are spaced apart by the thickness of the elongate support member 13.

The elongate support member 13 may be constructed as one integral member having first and second surfaces 16, 19 or may be constructed in layers that are attached to one another by adhesives, mechanical fasteners, or the like.

Figure 3:
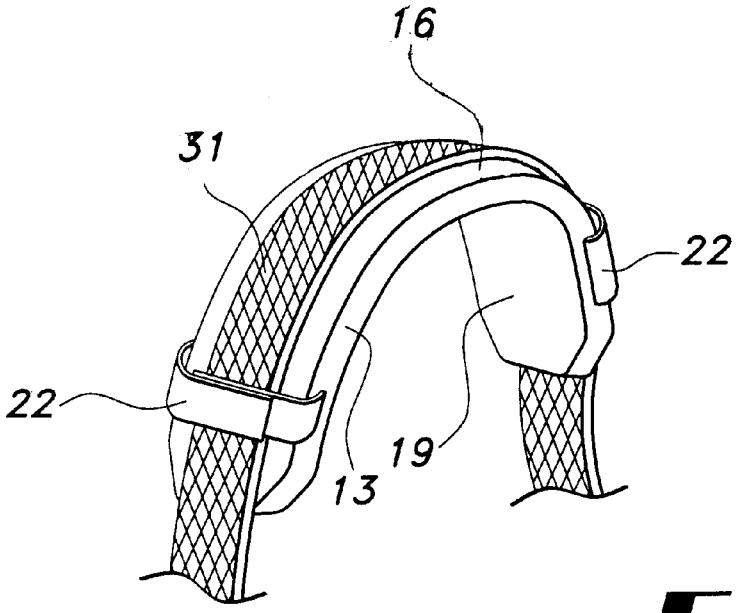
FIG. 3 is a perspective view of the device with a shoulder strap mounted thereon.

A pair of straps 22 have first and second ends 25, 28 that extend from opposite sides of the elongate support member 13 such that the ends can be removably attached to form a loop about a shoulder strap 31 attached to the item to be carried (shown in FIG. 3). The ends 25, 28 are preferably provided with hook and loop fastening members 29 and 30 such as VELCRO. Other fastening methods would also be suitable, such as buttons, hooks, or the like. Also, the surface 16 can be provided with protrusions 34 that, in combination with the straps 22, restrict the movement of the shoulder strap 31 to prevent slippage or shifting of the load.

Figure 2:
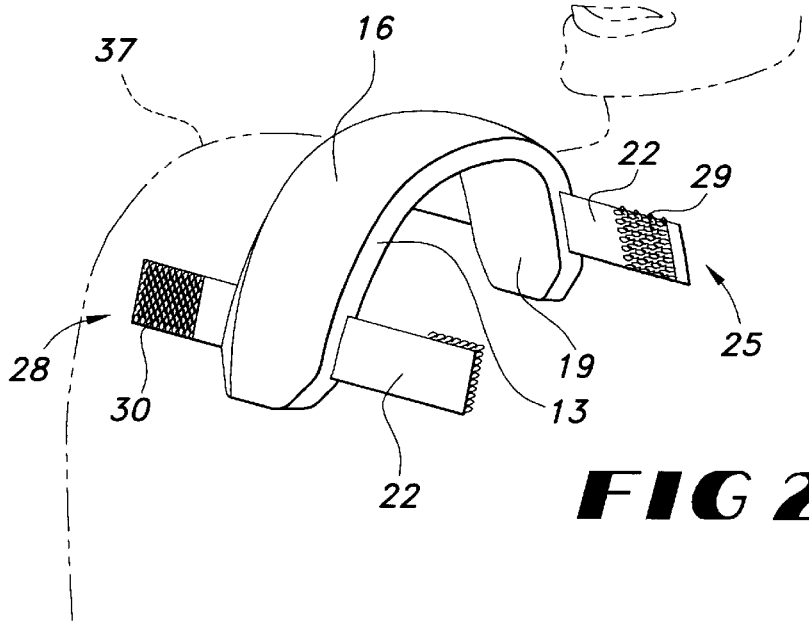
FIG. 2 is a perspective view of the device shaped to fit the shoulder of a user.

Turning to FIG. 2, the device 10 is deformable such that the second surface 19 conforms to the contours of the user's shoulder 37. The elongate support member 13 is preferably constructed of a cushioning non-slip material. The entire member 13 may be constructed of a foam rubber, such as a urethane-based rubber having a durometer between 40 and 60 shore A. Other materials and durometers would also be suitable. As an alternative, member 13 can be constructed of a layer of textured fabric permanently attached to a foam rubber piece such that the textured fabric engages the shoulder strap 31.

Turning to FIG. 3, the device 10 accepts a shoulder strap 31. The shoulder strap 31 is positioned along the longitudinal axis of the support member 13. The device 10 is shaped to conform to the shape of the shoulder 37 of the user (FIG. 2). The straps 22 wrap around the shoulder strap 31 to secure it into a fixed position relative to the device 10. The combination of the custom fit of the support member 13, the non-slip surface 19, and the straps 22 attached around the shoulder strap 31, provide a stable support for the shoulder strap 31 and inhibit the strap 31 from moving along the shoulder 37 (shown in FIG. 7) thereby inhibiting the load from shifting on the shoulder 37.

Figure 4:
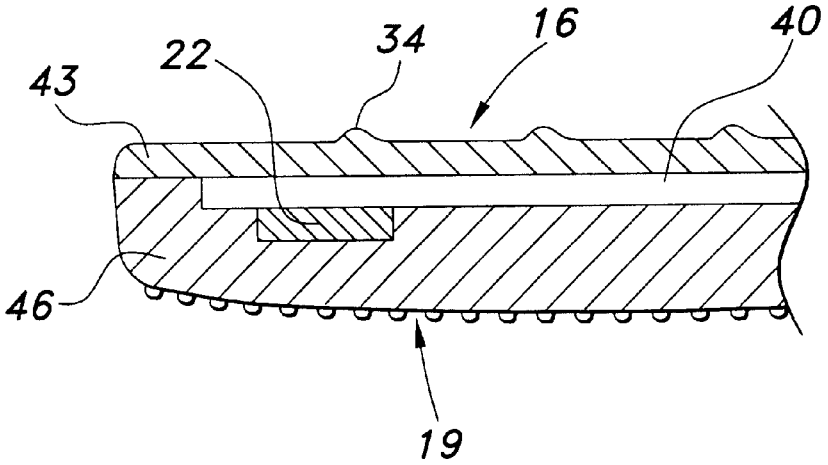
FIG. 4 is a cross-sectional view taken along lines 4—4 of FIG. 1.

As shown in FIG. 4, a rigid, deformable insert member 40 is disposed inside the elongate support member 13. The insert member 40 is preferably constructed of a malleable metal that can be bent such that it can be formed into a new shape and then can retain that shape until it is bent into a new shape. In between forming new shapes, the insert 40 retains sufficient rigidity such that it will maintain its shape under the load of the shoulder strap 31. In the preferred embodiment, the insert 40 is constructed of a malleable metal, such as a soft copper. Other materials including metals, plastics, rubbers, composites, or combinations thereof could also be used for insert 40, as known to those of skill in the art.

As an alternative, the insert 40 can be constructed of a non-deformable rigid material. For example a preformed, curved rigid insert could be constructed in different sizes to fit different shoulders without being deformable for a custom fit.

The device 10 is constructed in layers with the first layer 43 having the first surface 16 thereon. As shown, the first surface 16 has a plurality of protrusions 34 thereon. Other non-smooth surfaces including a textured fabric surface are also suitable. The surface 16 should be generally non-smooth such that motion of the shoulder strap 31 relative to the first surface 16 is inhibited.

The second layer 46 provides the second surface 19 thereon. The second layer 46 is preferably formed out of a foam rubber, such as a urethane-based rubber having a durometer between 40 and 60 shore A. Other foam based rubber-like materials would also be suitable. The main features of the second layer are providing cushioning for the shoulder and providing a non-slip surface 19 for engaging with the shoulder of the user.

The insert 40 and the strap 22 are preferably disposed between the layers 43, 46. The insert 40 is preferably completely enclosed by the layers 43, 46. A mid-portion of the strap 22 is completely surrounded by the layers 43, 46, but the ends remain free for forming a loop about the support member 13.

The first layer 43 and second layer 46 are preferably attached by adhesives. Other methods of permanently attaching the layers, such as stapling, seam welding, or the like would also be suitable. As stated above, the surface 19 preferably includes a non-smooth surface for engaging the shoulder 37 of the user, such as a ribbed foam rubber. The second layer 46 prevents slippage and provides cushioning for the deformable rigid insert 40 in relation to the shoulder 37 of the user.

A preferred construction of the present invention provides a multi-layered device. Other manufacturing methods would also be suitable. For example, instead of a layered construction with openings in the layered parts for receiving the insert 40, the insert 40 could be formed integrally inside the support member 13 by a molding process. The molding process could include a foam rubber-like material being formed by thermosetting the material around an insert 40 positioned in a mold. In this manner, the insert 40 could be embedded inside a single piece of foam rubber. This material could then be provided with surface treatments on the shoulder engaging and strap engaging sides, respectively.

Figure 5:
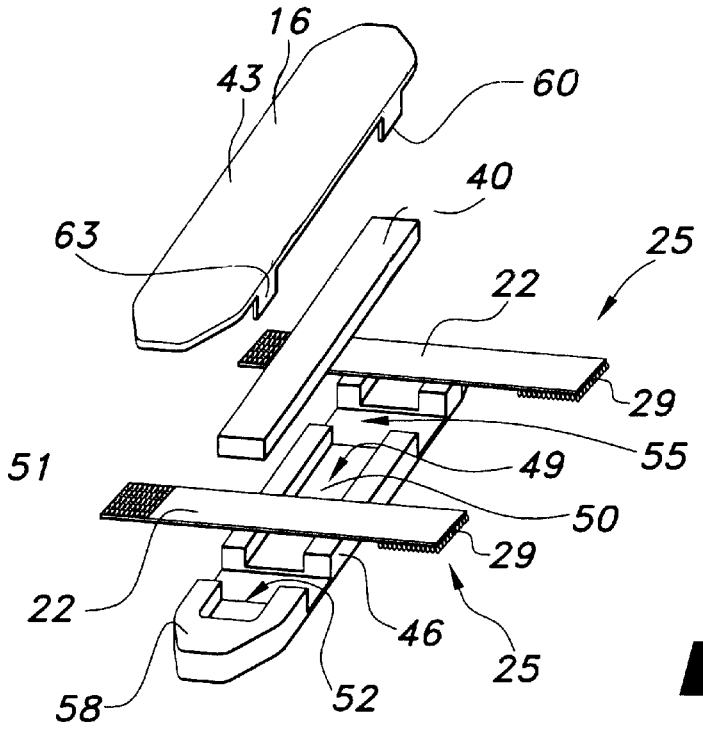
FIG. 5 is an exploded view of the device of the present invention.
Figure 6:
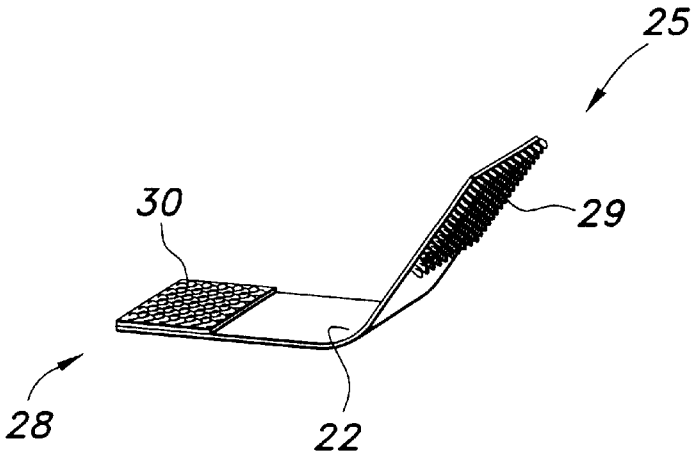
FIG. 6 is a perspective view of the strap of the present invention.

The preferred construction of the present invention is shown in FIG. 5. The second layer 46 has a longitudinal channel 49. The longitudinal channel 49 has a bottom wall 50 and a pair of side walls 51 that match the profile of the rigid insert 40 such that once the insert 40 is inserted into the channel 49 the top of the insert 40 is at approximately the same height as the second layer 46.

The second layer 46 also has a pair of transverse channels 52, 55. The transverse channels 52 and 55 are disposed perpendicular to the longitudinal axis of the support member 13. All of the channels are formed integrally in the second layer 46 during the molding process. The longitudinal channel 49 is capable of receiving the insert 40 such that it is flush with the top 58 of the second layer 46 when it is placed in the channel 49. The transverse channels 52, 55 receive the straps 22. The first layer 43 includes a pair of projections 60, 63 for mating with the transverse channels 52, 55. The first and second layers 43 and 46 are preferably attached to each other with adhesives such that the straps 22 and insert 40 are held in position in the longitudinal and transverse channels.

If the straps 22 are thin, the lateral channels 52, 55 can be omitted, and the straps 22 can be held between the first and second layers 43, 46.

Accordingly, the present invention advantageously provides an adjustable, shoulder strap assisting device 10 capable of conforming to the contour of the user's shoulder 37. A shoulder strap 31 can be removably attached to the device 10 such that when the shoulder strap 31 is positioned on the device 10, the strap 31 is prevented from sliding on the shoulder 37. If the strap 31 is prevented from sliding on the shoulder 37, the load supported by the shoulder strap 31 is prevented from shifting or sliding off of the shoulder which reduces the risk of accident or injury.

As described above, the present invention can be utilized as a stand-alone assisting device 10 for use with the shoulder straps 31 on backpacks, golf bags, or the like.

Figure 7:
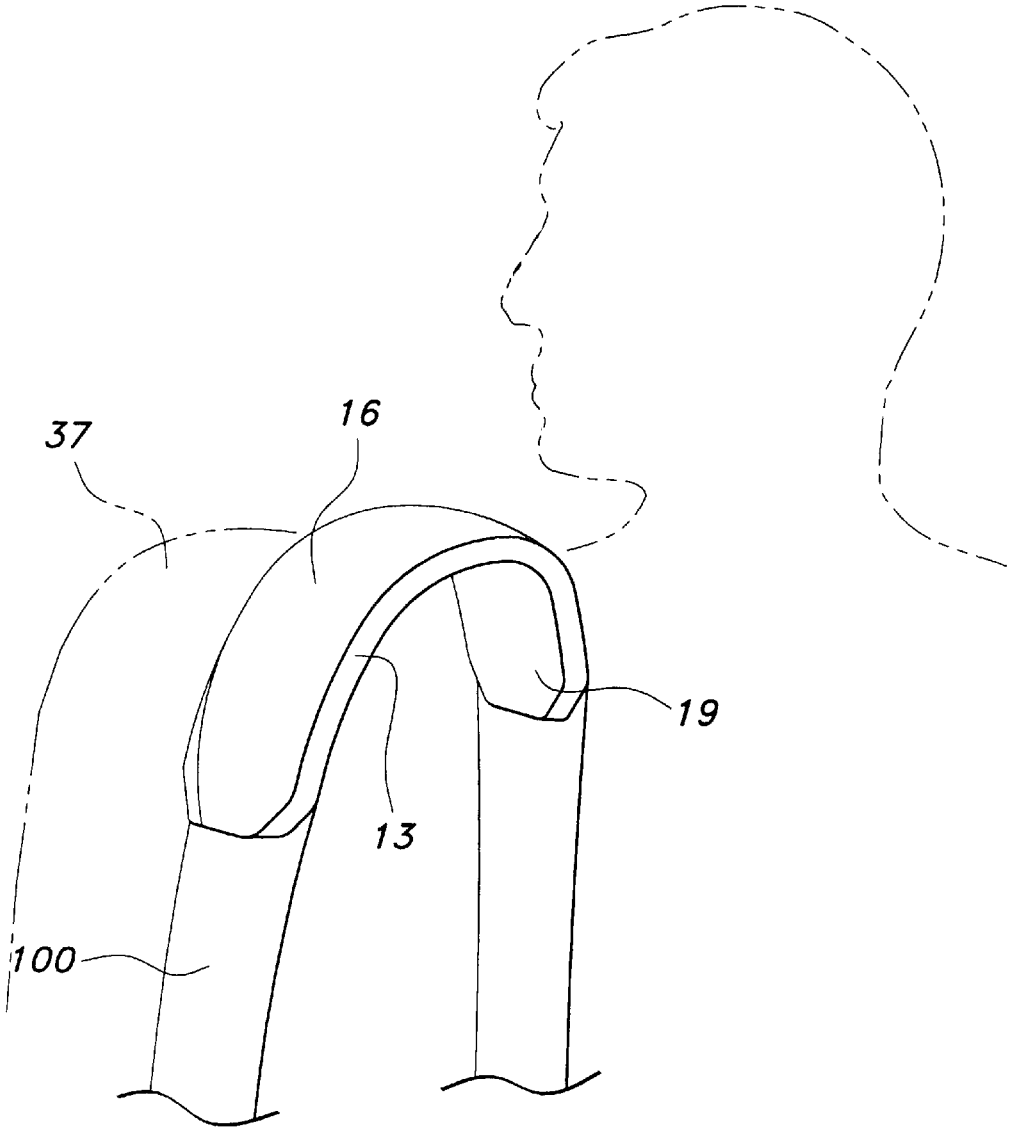
FIG. 7 is a perspective view of an alternate embodiment of the present invention.

However, the design of the present invention can also easily be incorporated as an integral feature of the design of a shoulder strap, as shown in FIG. 7. In FIG. 7, a shoulder strap 100 includes a shoulder portion having an elongate support member 13 with a first surface 16 and a second surface 19. A deformable, rigid insert 40 is disposed inside the support member 13 such that the member 13 can be shaped to conform to the contour of the shoulder 37 of the user.

While the invention has been described in connection with certain preferred embodiments, it is not intended to limit the scope of the invention to the particular forms set forth, but on the contrary, it is intended to cover such alternatives, modifications, and equivalents as may be included within the spirit and scope of the invention as defined by the claims.

What is claimed is:

1. A shoulder strap assisting device for positioning a shoulder strap on a person's shoulder, comprising:

an elongate support member having a first layer with a non-smooth surface on a first side and a second side, the support member having a second layer having a non-smooth surface on a first side and having a second side, the second layer being attached to the first layer;

a rigid insert disposed between the first and second layer;

at least one pair of straps disposed between the first and second layers, each strap being capable of attaching to itself to form a loop about the surface of the first layer of the support member, wherein the second layer has a channel disposed therein capable of receiving the insert and a channel disposed therein capable of receiving the at least one pair of straps.

2. The shoulder strap assisting device of claim 1, wherein the insert is deformable.

3. The shoulder strap assisting device of claim 1, further comprising a textured surface on the support member on the first side of the second layer.

4. The shoulder strap assisting device of claim 1, wherein the support member has a plurality of protrusions disposed on the first side of the first layer.

5. A shoulder strap assisting device for positioning a shoulder strap on a person's shoulder, comprising:

an elongate support member having a non-smooth surface on a shoulder engaging side;

a rigid insert disposed inside the support member such that the support member conforms to the shape of the shoulder;

at least one pair of straps disposed such that the ends of each strap are capable of attaching to each other around the shoulder strap, wherein the pair of straps are disposed substantially perpendicular to a longitudinal axis of the support member and attach around a portion the support member to hold the shoulder strap in a fixed position relative to the support member.

6. The shoulder strap assisting device of claim 5, wherein the elongate support member is formed out of a first layer and a second layer, the first and second layers being attached to each other such that the rigid, deformable insert is disposed between the layers.

7. The shoulder strap assisting device of claim 6, wherein the first layer has at least one protrusion disposed thereon.

8. The shoulder strap assisting device of claim 5, wherein the insert is deformable.

9. A shoulder strap assisting device, comprising;

an elongate support member having a first layer with a non-smooth surface on one side and a second layer having a non-smooth surface on one side and being attached to the first layer;

a rigid insert disposed between the first and second layers;

a pair of straps disposed between the first and second layers and disposed substantially perpendicular to a longitudinal axis of the elongate support member, each of the straps being capable of attaching at opposite ends to form a loop.

10. The shoulder strap assisting device of claim 9, wherein the insert is deformable.

11. The shoulder strap assisting device of claim 9, wherein the non-smooth surface on the second layer is formed out of a foam rubber-like material.

12. The shoulder strap assisting device of claim 9, wherein the non-smooth surface on the second layer is ribbed.

13. The shoulder strap assisting device of claim 9, wherein the first layer has protrusions on the surface thereof capable of engaging the shoulder strap.

14. The shoulder strap assisting device of claim 9, wherein the straps have hook and loop fasteners at opposite ends.

15. The shoulder strap assisting device of claim 9, wherein the first layer is comprised of fabric.

16. The shoulder strap assisting device of claim 9, wherein the first layer is comprised of a foam rubber-like material.

17. The shoulder strap assisting device of claim 9, wherein the first layer has at least two protrusions extending above the surface of the first layer such that when the shoulder strap abuts with the first layer, the protrusions are disposed on opposite sides of the shoulder strap to prevent movement of the shoulder strap relative to the shoulder strap assisting device.

18. A shoulder strap assisting device, comprising:

an elongate support member having a first layer with a non-smooth surface on one side and a second layer having a non-smooth surface on one side and being attached to the first layer;

a rigid insert disposed between the first and second layers;

at least one pair of straps disposed between the first and second layers and each capable of forming a loop about one of the layers of the elongate support member.

* * * * *

UNITED STATES PATENT AND TRADEMARK OFFICE

CERTIFICATE OF CORRECTION

PATENT NO. : 6,467,661 B1
DATED : October 22, 2002
INVENTOR(S) : Mistretta et al.

It is certified that error appears in the above-identified patent and that said Letters Patent is hereby corrected as shown below:

Column 5,
Line 57, after "portion" insert -- of --.

Signed and Sealed this

Eighteenth Day of February, 2003

JAMES E. ROGAN
*Director of the United States Patent and Trademark Office*